US005872514A

United States Patent [19]

Neas

[11] Patent Number: 5,872,514

[45] Date of Patent: Feb. 16, 1999

[54] ALARM DEVICE WITH DOOR/WINDOW CROSS-BAR

[76] Inventor: Traci L. Neas, 16222 Clay Rd., #1002, Houston, Tex. 77084

[21] Appl. No.: 800,744

[22] Filed: Feb. 14, 1997

[51] Int. Cl.[6] ..... G08B 13/08

[52] U.S. Cl. ..... 340/545.1; 340/541; 340/550

[58] Field of Search ..... 340/550, 546, 340/545, 542, 426, 547, 541; 307/10.6, 10.2

[56] References Cited

U.S. PATENT DOCUMENTS

| | | | |
|---|---|---|---|
| 4,027,170 | 5/1977 | Hollins | 307/10.6 |
| 4,553,134 | 11/1985 | Holt | 340/545 |
| 4,631,528 | 12/1986 | Handel et al. | 340/545 |
| 4,837,557 | 6/1989 | Striebel | 340/546 |
| 4,888,578 | 12/1989 | Conemac | 340/546 |
| 4,896,139 | 1/1990 | Eldridge | 340/546 |
| 5,258,741 | 11/1993 | Fuller | 340/546 |

*Primary Examiner*—Jeffery A. Hofsass
*Assistant Examiner*—Davetta Woods
*Attorney, Agent, or Firm*—Joseph N. Breaux

[57] ABSTRACT

An alarm device with cross-bar that includes a telescoping cross-bar having a spring tensioning mechanism; an alarming circuit having a pair of contact points extending out from a contact point end of the cross bar; and a contact bracket, sized to detachably hold the contact point end of the cross-bar, having a moveable contact plate constructed from an electrically conductive material provided thereon in a manner such that both of the contact points of the alarm circuit contact the moveable contact plate when the contact end of the cross-bar is held by the contact bracket. The moveable contact plate is preferably pivotally supported from a central point. In a preferred embodiment the alarm circuit of the alarm device further includes a key-strip upon which a preselected deactivation code must be entered to turn off the alarm device after activation of the audible alarm.

9 Claims, 3 Drawing Sheets

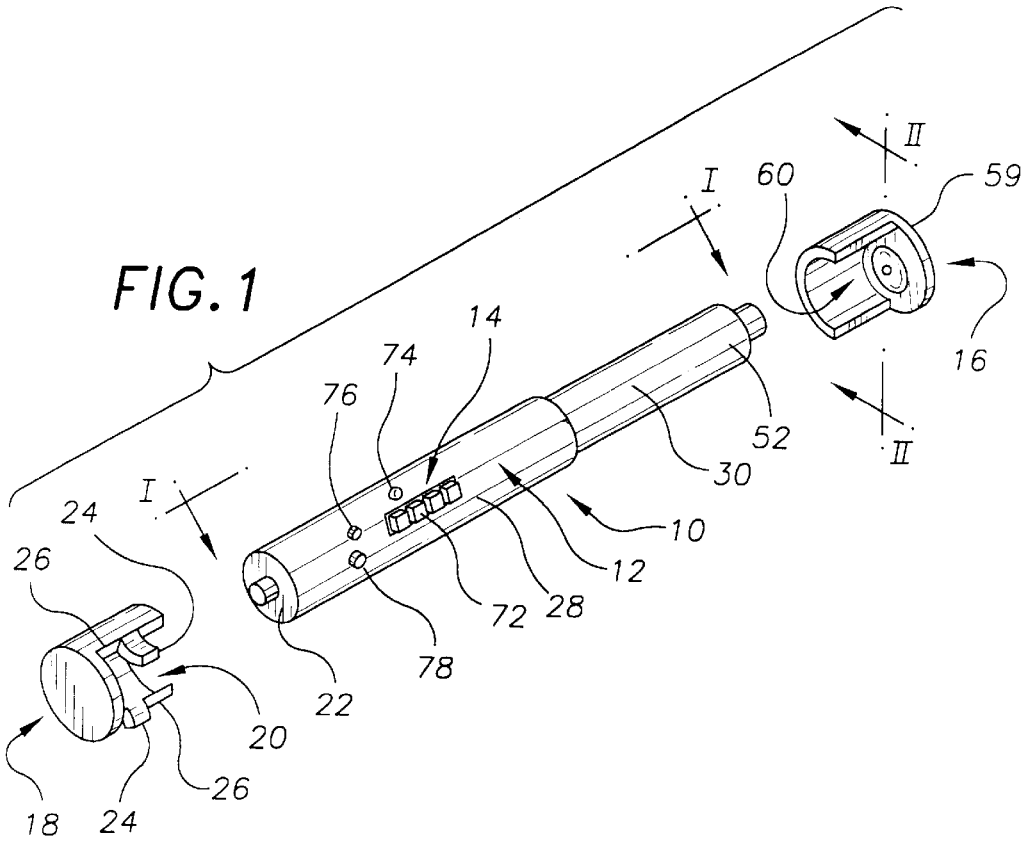
FIG. 2
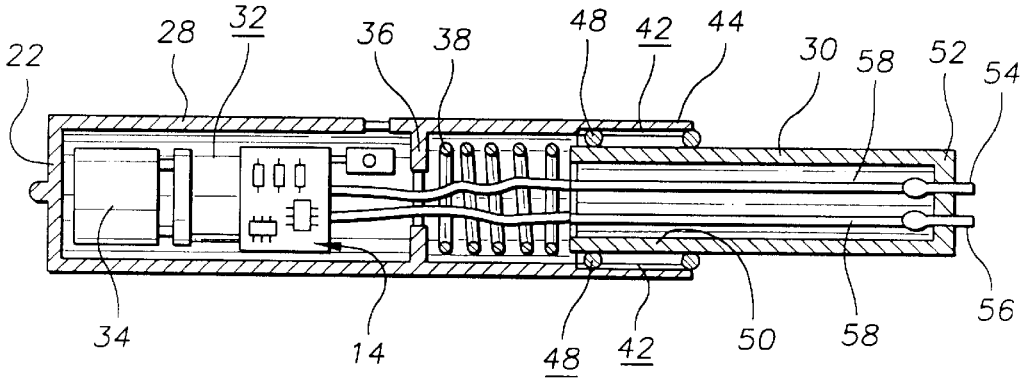

ALARM DEVICE WITH DOOR/WINDOW CROSS-BAR

TECHNICAL FIELD

The present invention relates to alarm devices for doors and windows and more particularly to an alarm device for doors and windows that includes a cross-bar having a spring tensioning mechanism; an alarming circuit having a pair of contact points extending out from a contact point end of the cross bar; and a contact bracket, sized to detachably hold the contact point end of the cross-bar, having a moveable contact plate constructed from an electrically conductive material provided thereon in a manner such that both of the contact points of the alarm circuit contact the moveable contact plate when the contact end of the cross-bar is held by the contact bracket.

BACKGROUND OF THE INVENTION

Many individuals feel that need to provide increased security to their dwellings by providing an alarm mechanism that activates an audible alarm when an intruder enters the dwelling through a door or window. It would be a benefit, therefore, to have an alarm device having a cross-bar that could be placed across a window or door opening that would block the window or door sufficiently to require dislodgement of the cross-bar before any intruder could enter the dwelling and that emitted an audible alarm when dislodged to warn occupants of the dwelling that an intruder was attempting to enter the dwelling.

SUMMARY OF THE INVENTION

It is thus an object of the invention to provide an alarm device with door/window cross-bar wherein the cross-bar can be placed across a window or door opening to block the window or door.

It is a further object of the invention to provide an alarm device with cross/bar that is activated upon dislodgement of the cross-bar.

It is a further object of the invention to provide an alarm device with door/window cross-bar that includes a telescoping cross-bar having a spring tensioning mechanism; an alarming circuit having a pair of contact points extending out from a contact point end of the cross bar; and a contact bracket, sized to detachably hold the contact point end of the cross-bar, having a moveable contact plate constructed from an electrically conductive material provided thereon in a manner such that both of the contact points of the alarm circuit contact the moveable contact plate when the contact end of the cross-bar is held by the contact bracket.

It is a still further object of the invention to provide an alarm device with door/window cross-bar that includes an alarm circuit having a key-strip for entering a deactivation code to turn off the alarm after the alarm circuit is tripped.

It is a still further object of the invention to provide an alarm device with door/window cross-bar that accomplishes some or all of the above objects in combination.

Accordingly, an alarm device with cross-bar is provided. The alarm device with cross-bar includes a telescoping cross-bar having a spring tensioning mechanism; an alarming circuit having a pair of contact points extending out from a contact point end of the cross bar; and a contact bracket, sized to detachably hold the contact point end of the cross-bar, having a moveable contact plate constructed from an electrically conductive material provided thereon in a manner such that both of the contact points of the alarm circuit contact the moveable contact plate when the contact end of the cross-bar is held by the contact bracket. Use of a moveable contact plate insures contact between the contact plate and both of the contact points and, thereby, eliminates problems caused by slight misalignments between the contact plate and the two contact points that result in only one of the contacts contacting the contact plate. The moveable contact plate is preferably pivotally supported from a central point. In a preferred embodiment the alarm circuit of the alarm device further includes a key-strip upon which a preselected deactivation code must be entered to turn off the alarm device after activation of the audible alarm.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a perspective view of an exemplary embodiment of the alarm device with cross-bar of the present invention showing the telescoping cross-bar with spring tensioning mechanism; the key-strip, the contact points, the power switch, the code entering switch, and the indicator LED of the alarming circuit; the contact bracket including the moveable contact plate; and the optional securing bracket.

FIG. 2 is a cross-sectional view of the alarm device of FIG. 1 along the line I—I showing the circuit end and the contact end of the telescoping cross-bar; the tensioning spring; and the alarm circuit board, the battery connector, the point contacts, and the piezo electric buzzer of the alarm circuit.

DESCRIPTION OF THE EXEMPLARY EMBODIMENT

Figure 2A:
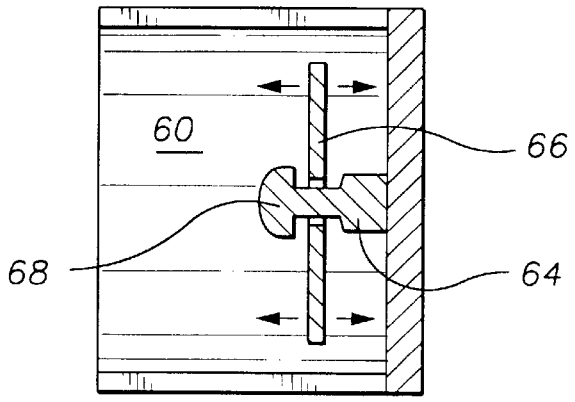
FIG. 2A is a cross-sectional view of the contact bracket of FIG. 1 along the line II—II showing the central contact plate support, the moveable contact plate and the bracket wall.

FIG. 1 shows an exemplary embodiment of the alarm device with cross-bar of the present invention, generally designated by the numeral 10. In this embodiment alarm device 10 includes a telescoping cross-bar, generally designated by the numeral 12; an alarm circuit, generally designated by the numeral 14 (more clearly shown in FIG. 2); a contact bracket, generally designed by the numeral 16; and a securing bracket, generally designated by the numeral 18. Securing bracket 18 is molded from plastic and includes a half cylindrical shaped rod receiving cavity 20 sized to receive a second end 22 of telescoping cross-bar 12. Two resilient retaining clips 24 are provided along the side edges 26 of securing bracket 18 to resiliently retain second end 22 within rod receiving cavity 20.

Telescoping cross-bar 12 includes an outer section 28 and an inner section 30. Outer section 28 and inner section 30 are each sections of glass filled, automotive grade, ABS plastic tubing. Referring now to FIG. 2, outer section 28 is sealed at second end 22 and has a cavity 32 provided adjacent to second end 22 that contains a battery 34 for powering alarm circuit 14. A spring barrier 36 is provided within outer section 28 to provide a support for one end of a spring 38 that forms part of the tensioning mechanism. A pair of stop channels 42 are provided along the interior surface of a first end 44 of outer section 28.

Each stop channel 42 has a section stop 48 entrapped therein and slidable thereamong. Section stops 48 extend outwardly from a third end 50 of inner section 30. Section stops 48 limit the motion of inner section 30 with respect to outer section 28 between a fully inserted position and a fully extended position and prevent inner section 30 from being completely withdrawn from outer section 28. Spring 38 is of a length sufficient to bias inner section 30 toward and into the fully extended position when no force is applied to inner section 30.

Inner section 30 has a contact end 52 having first and second pint contacts 54, 56 extending outwardly therefrom. First and second contacts 54, 56 are each connected to alarm circuit 14 by a wire 58. Wires 58 are of sufficient length to allow inner section 30 to move to the fully extended position.

Referring back to FIG. 1, contact bracket 16 has a bracket portion 59 that is molded from plastic and forms a half cylindrical contact end receiving cavity 60 sized to receive and hold contact end 52 therein. Referring now to FIG. 2A, a central contact plate support 64 extends into contact end receiving cavity 60 and supports a metal contact plate 66 in a manner such that contact plate 66 is free to pivot freely. Supporting contact plate 66 in a manner to allow it to pivot freely about contact support 64 allows contact plate 66 to move sufficiently to insure contact between contact plate 66 and contact points 54, 56. A retaining tab 68 is formed at the end of contact plate support 64 to retain contact plate 66 on contact plate support 64.

Figure 3:
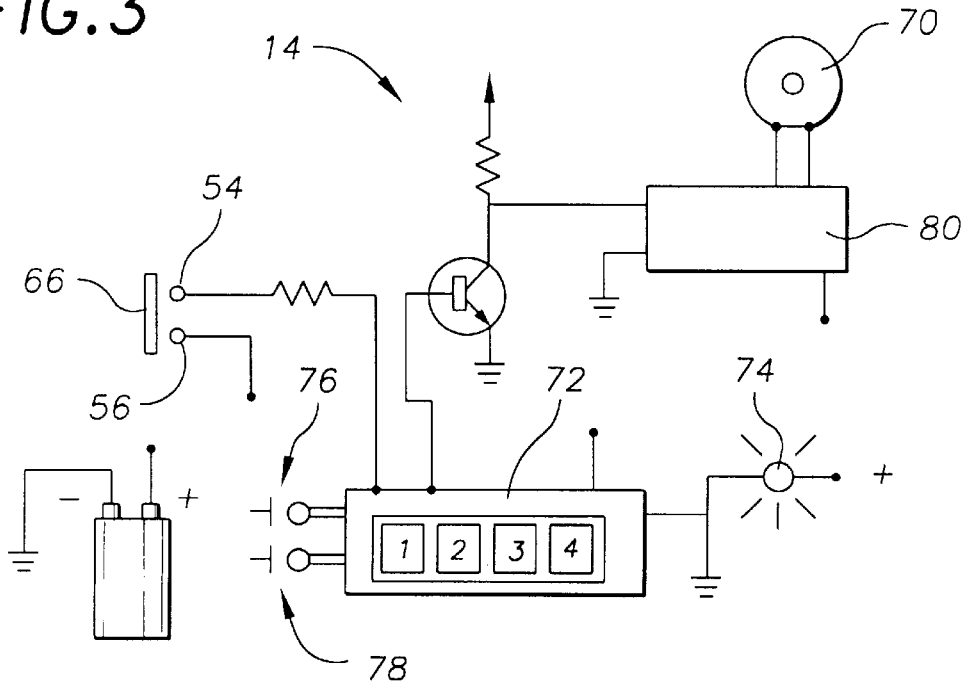
FIG. 3 is a schematic diagram of the alarm circuit showing the key-strip, the contact points, the contact plate, and the conventional alarm circuitry.

FIG. 3 shows exemplary alarm circuit 14 schematically. Alarm circuit 14 is electrically connected to contact points 54, 56 and emits an audible alarm through a piezo electric buzzer 70 when contact points 54, 56 are not in electrical contact through contact with contact plate 66. Alarm circuit 14 also includes a conventional four-key key-strip 72, an indicator LED 74, a power switch 76, an enter programming switch 78, and logic and control circuitry 80.

Figure 4:
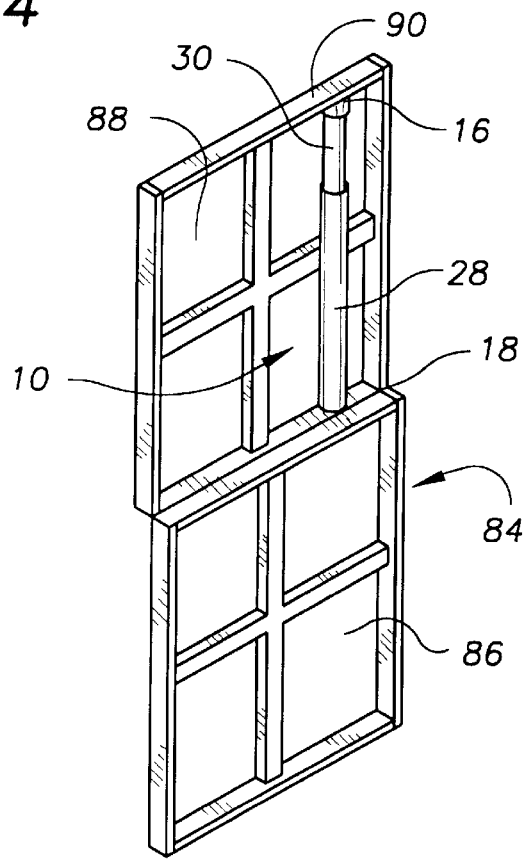
FIG. 4 is a perspective view of the alarm device with cross/bar of FIG. 1 in use with a representative window assembly.
Figure 5:
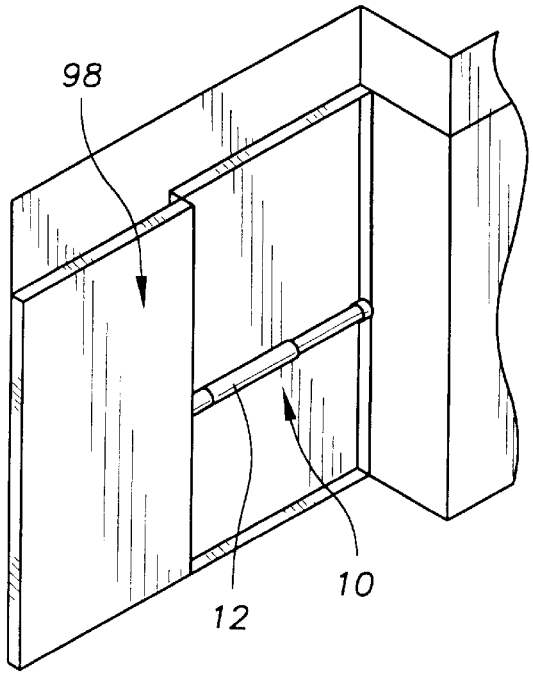
FIG. 5 is a perspective view of the alarm device with cross-bar of FIG. 1 in use with a representative sliding door assembly.

FIGS. 4 and 5 illustrate installation and operation of alarm device 10. FIG. 4 shows alarm device 10 installed in a representative window assembly, generally designated by the numeral 84. Window frame assembly 84 includes a lower sliding window 86, a stationary window 88, and an upper window jam 90. Alarm device 10 is installed by securing contact bracket 16 to upper window jam 90 and securing bracket 18 to the top of lower sliding window 86. Once contact bracket 16 and securing bracket 18 are in place, inner section 30 of telescoping cross-bar 12 is compressed into outer section 28. With reference back to FIG. 1, second end 22 of cross-bar 12 is then placed into securing bracket 18 and contact end 52 placed into contact bracket 16 by slowing releasing inner section 30 in a manner such that telescoping cross-bar 12 expands to the required length. Alarm device 10 is then armed by depressing power/on button 76 until indicator LED 74 lights. While armed, breaking electrical contact between point contacts 54 and 56 will initiate an audible alarm that can only be silenced by entering a preselected sequence of numbers into key-strip 72. The preselected sequence is set by the user prior to arming alarm device 10 by depressing enter programing switch 78 until indicator LED 74 blinks. The disarming sequence is then entered and enter programming switch 78 depressed until indicator LED 74 is extinguished. FIG. 5 shows an exemplary installation of alarm device 10 in a sliding door assembly, generally indicated by the numeral 98. In this installation cross-bar 12 is installed horizontally.

It can be seen from the preceding description that an alarm device with door/window cross-bar has been provided that includes a cross-bar that can be placed across a window or door opening to block the window or door; that is activated upon dislodgement of the cross-bar; that includes a telescoping cross-bar having a spring tensioning mechanism; an alarming circuit having a pair of contact points extending out form a contact point end of the cross bar; and a contact bracket, sized to detachably hold the contact point end of the cross-bar, having a moveable contact plate constructed from an electrically conductive material provided thereon in a manner such that both of the contact points of the alarm circuit contact the moveable contact plate when the contact end of the cross-bar is held by the contact bracket; and that includes an alarm circuit having a key-strip for entering a deactivation code to turn off the alarm one the alarm circuit is tripped.

It is noted that the embodiment of the alarm device with door/window cross-bar described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An alarm device with door/window cross-bar comprising:

a telescoping cross-bar having a spring tensioning mechanism;

an alarming circuit having a pair of contact points extending out from a contact point end of said cross bar and an audible alarm; and a contact bracket, sized to detachably hold a contact point end of said cross-bar, having a moveable contact plate constructed from an electrically conductive material provided thereon in a manner such that both of said contact points of said alarm circuit contact said moveable contact plate when said contact end of said cross-bar is held by said contact bracket;

said moveable contact plate being pivotally supported from a central point.

2. An alarm device with door/window cross-bar comprising:

a telescoping cross-bar having a spring tensioning mechanism;

an alarming circuit having a pair of contact points extending out from a contact point end of said cross bar and an audible alarm; and a contact bracket, sized to detachably hold a contact point end of said cross-bar, having a moveable contact plate constructed from an electrically conductive material provided thereon in a manner such that both of said contact points of said alarm circuit contact said moveable contact plate when said contact end of said cross-bar is held by said contact bracket;

said contact bracket having a bracket portion that a half cylindrical shaped contact end receiving cavity sized to receive and hold said contact end therein, and a central contact plate support that extends into said contact end receiving cavity and supports said contact plate in a manner such that said contact plate is free to pivot freely, said central contact plate support having a retaining tab formed at an end thereof that retains said contact plate on said contact plate support.

3. The alarm device with door/window cross-bar of claim 1, wherein:

said alarm circuit includes a key-strip upon which a preselected deactivation code must be entered to turn off said alarm device after activation of said audible alarm.

4. The alarm device with door/window cross-bar of claim 1 further including:

a securing bracket having a half cylindrical shaped rod receiving cavity formed therein that is sized to receive a second end of said telescoping cross-bar, said securing bracket having two resilient retaining clips provided along side edges of said securing bracket in a manner to resiliently retain said second end within said rod receiving cavity.

5. The alarm device with door/window cross-bar of claim 1 wherein:

said contact bracket has a bracket portion that a half cylindrical shaped contact end receiving cavity sized to receive and hold said contact end therein, and a central contact plate support that extends into said contact end receiving cavity and supports said contact plate in a manner such that said contact plate is free to pivot freely, said central contact plate support having a retaining tab formed at an end thereof that retains said contact plate on said contact plate support.

6. The alarm device with door/window cross-bar of claim 3 further including:

a securing bracket having a half cylindrical shaped rod receiving cavity formed therein that is sized to receive a second end of said telescoping cross-bar, said securing bracket having two resilient retaining clips provided along side edges of said securing bracket in a manner to resiliently retain said second end within said rod receiving cavity.

7. The alarm device with door/window cross-bar of claim 3 wherein:

said contact bracket has a bracket portion that a half cylindrical shaped contact end receiving cavity sized to receive and hold said contact end therein, and a central contact plate support that extends into said contact end receiving cavity and supports said contact plate in a manner such that said contact plate is free to pivot freely, said central contact plate support having a retaining tab formed at an end thereof that retains said contact plate on said contact plate support.

8. The alarm device with door/window cross-bar of claim 6 wherein:

said contact bracket has a bracket portion that a half cylindrical shaped contact end receiving cavity sized to receive and hold said contact end therein, and a central contact plate support that extends into said contact end receiving cavity and supports said contact plate in a manner such that said contact plate is free to pivot freely, said central contact plate support having a retaining tab formed at an end thereof that retains said contact plate on said contact plate support.

9. The alarm device with door/window cross-bar of claim 4 wherein:

said contact bracket has a bracket portion that a half cylindrical shaped contact end receiving cavity sized to receive and hold said contact end therein, and a central contact plate support that extends into said contact end receiving cavity and supports said contact plate in a manner such that said contact plate is free to pivot freely, said central contact plate support having a retaining tab formed at an end thereof that retains said contact plate on said contact plate support.

* * * * *